US007392962B2

(12) United States Patent
Hsiu-Man

(10) Patent No.: US 7,392,962 B2
(45) Date of Patent: Jul. 1, 2008

(54) TAPE DISPENSER WITH A DRAWER

(76) Inventor: Yu Chen Hsiu-Man, No. 40, Sec. 1, Ta Fu Road, Tan Tzu Hsiang, Taichung (TW) 427

( * ) Notice: Subject to any disclaimer, the term of this patent is extended or adjusted under 35 U.S.C. 154(b) by 452 days.

(21) Appl. No.: 11/158,056

(22) Filed: Jun. 22, 2005

(65) Prior Publication Data

US 2006/0289594 A1 Dec. 28, 2006

(51) Int. Cl.
*B65H 75/18* (2006.01)

(52) U.S. Cl. ..... 242/588.6; 242/599.3

(58) Field of Classification Search ..... 242/588, 242/588.6, 599.3; 225/39, 47
See application file for complete search history.

(56) References Cited

U.S. PATENT DOCUMENTS 4,727,610 A * 3/1988 Lin ..... 7/160
6,651,857 B1 * 11/2003 Tsai ..... 225/42
2006/0186015 A1 * 8/2006 Abshire ..... 206/528

* cited by examiner

*Primary Examiner*—William A Rivera
(74) *Attorney, Agent, or Firm*—Ming Chow; Sinorica, LLC

(57) ABSTRACT

A tape dispenser with a drawer includes a housing provided with a tape recess on an upper surface, at least a hollow space formed in a lower portion of the housing, and at least one drawer movably received in the hollow space. Two lengthwise sidewalls defining the hollow space are provided respectively with a first fitting member, and the drawer has a second fitting member formed in a rear end. The hollow space has its bottom provided with at least a first slide guiding member to fit with a second slide guiding member provided in the bottom of the drawer to slide thereon. A first stopper is provided at the front end of the first slide-guiding member and a second stopper is provided at the rear end of the second slide-guiding member. When the drawer is pulled out, the second stopper is stopped by the first stopper to prevent the drawer from falling off.

9 Claims, 7 Drawing Sheets

TAPE DISPENSER WITH A DRAWER

BACKGROUND OF THE INVENTION

1. Field of the Invention

This invention relates to a tape dispenser, particularly to one provided with one or two drawers for placing therein small things.

2. Description of the Prior Art

Most conventional tape dispensers are provided with a housing composed of an upper housing and a lower housing, a saw-toothed blade fixed on an upper front end of the upper housing for cutting a tape from a tape roll, and a tape recess formed in an intermediate portion of the upper housing for the tape roll to be fitted therein and supported by a shaft to rotate.

However, the housing composed of the upper and the lower housing has a hollow interior with a weight of a sand bag for augment the weight of the tape dispenser to prevent the tape dispenser from move randomly in case of the tape is pulled out from the tape roll for use. But there is left still a large portion of the housing not used effectively, forming a kind of waste.

SUMMARY OF THE INVENTION

The purpose of the invention is to offer a tape dispenser provided with one or two drawers for placing therein small things like clips, erasers, etc.

The feature of the invention is an upper housing and a lower housing of a tape dispenser, and the lower housing provided with at least an a hollow space for a drawer to be received and able to be moved outward and inward for small things to be stored therein. The two opposite sidewalls defining the hollow space are provided respectively with a first fitting member at the rear end, and the drawer is provided with a second fitting member respectively at the rear side of two opposite sidewalls, and the first fitting members and the second fitting members fit each other when the drawer is pushed totally in the interior hollow to keep the drawer stably therein. Further, the bottom wall of the hollow space is provided at least with a first slide guiding member, and the drawer is provided with a second slide guiding member in the bottom surface, so the first and the second slide guiding member fitted with each other can guide the drawer to move out and in smoothly. Moreover, the front end of the first slide guiding member is provided with a first stopper and the rear end of the second guiding member is provided with a second stopper, so the second stopper may be blocked by the first stopper when the drawer is pulled out totally for keeping the drawer from falling out of the housing. So the tape dispenser makes use of the interior space effectively, with the drawer useful for storing small things therein.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
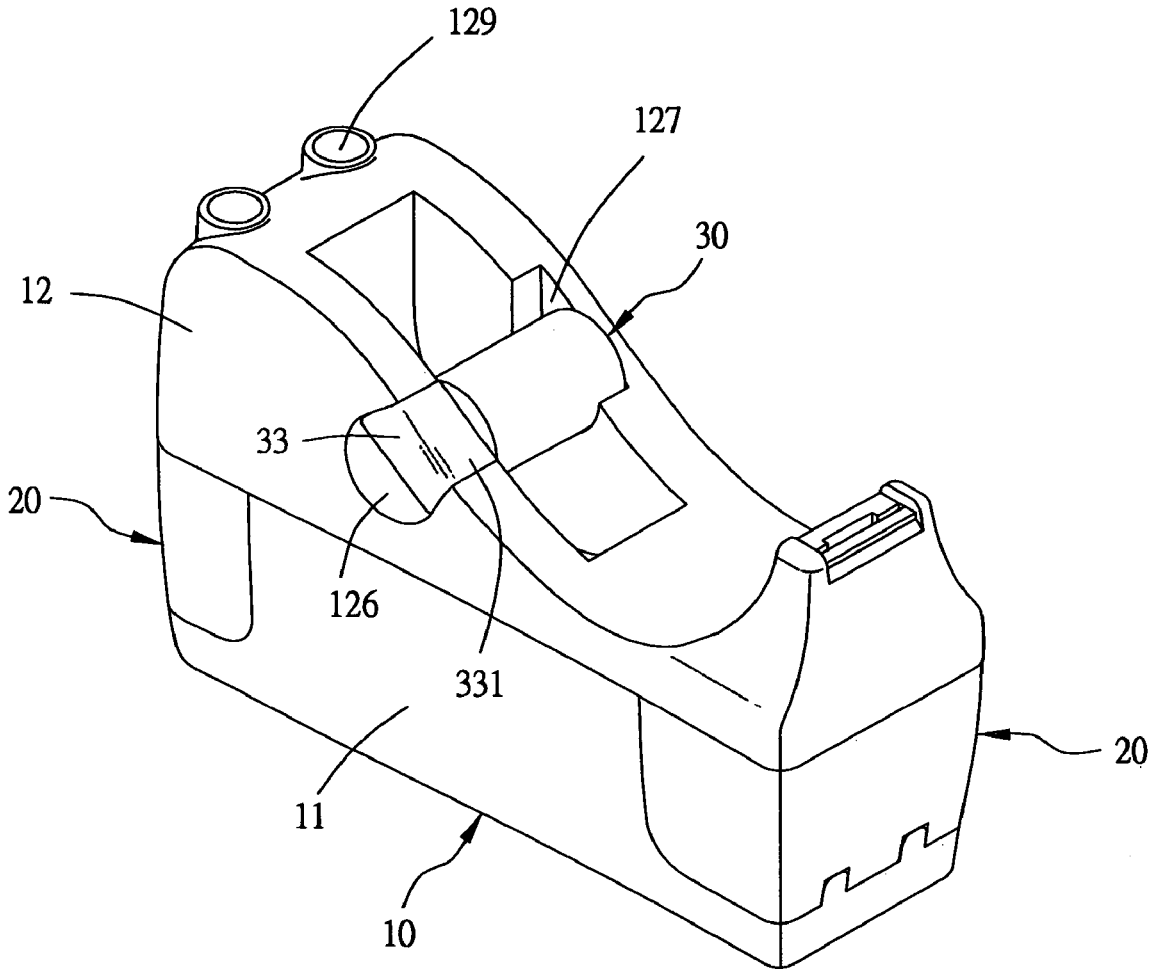
FIG. 1 is a perspective view of a tape dispenser with a drawer in the present invention.
Figure 2:
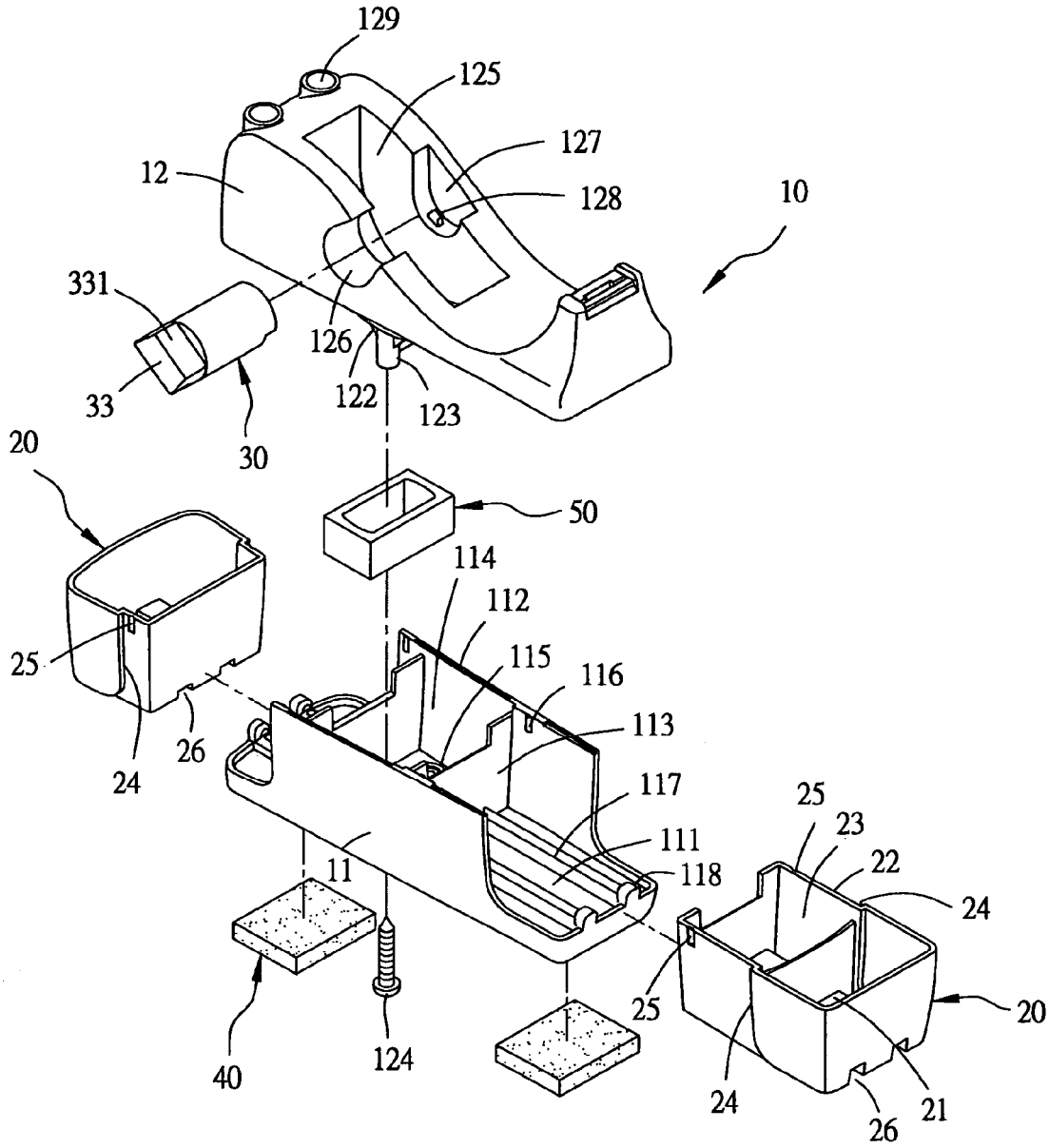
FIG. 2 is an exploded perspective view of the tape dispenser with a drawer in the present invention.
Figure 3:
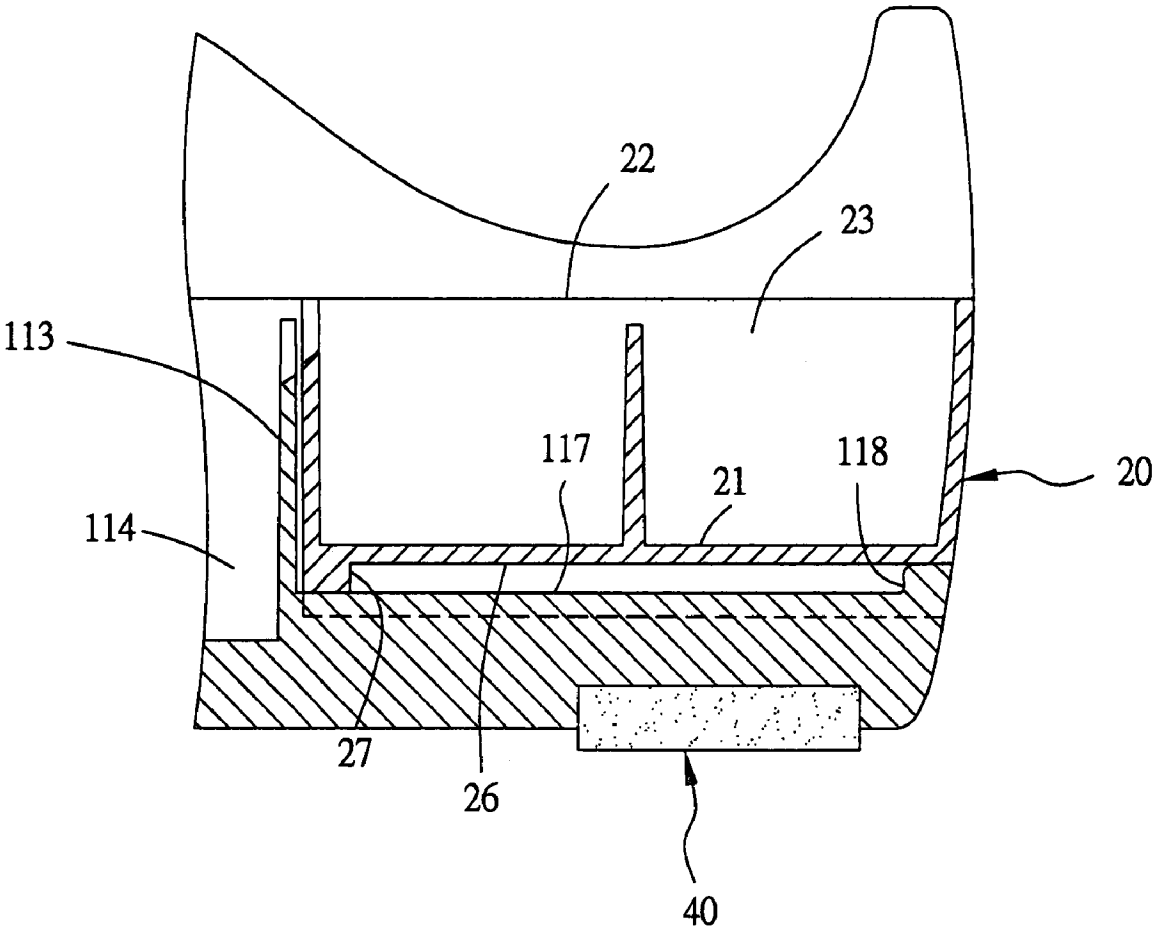
FIG. 3 is a side cross-sectional view of a drawer with a rail groove in the present invention.
Figure 4:
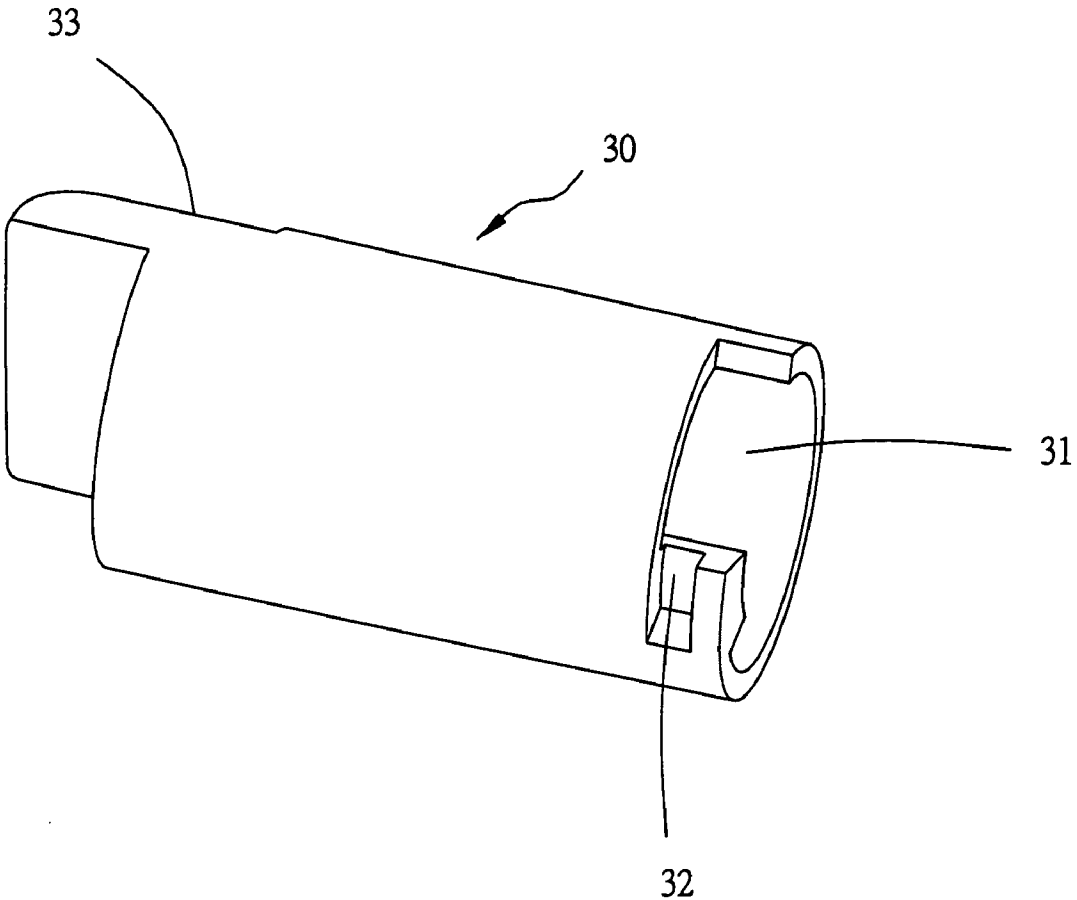
FIG. 4 is a perspective view of a shaft in the present invention.
Figure 5:
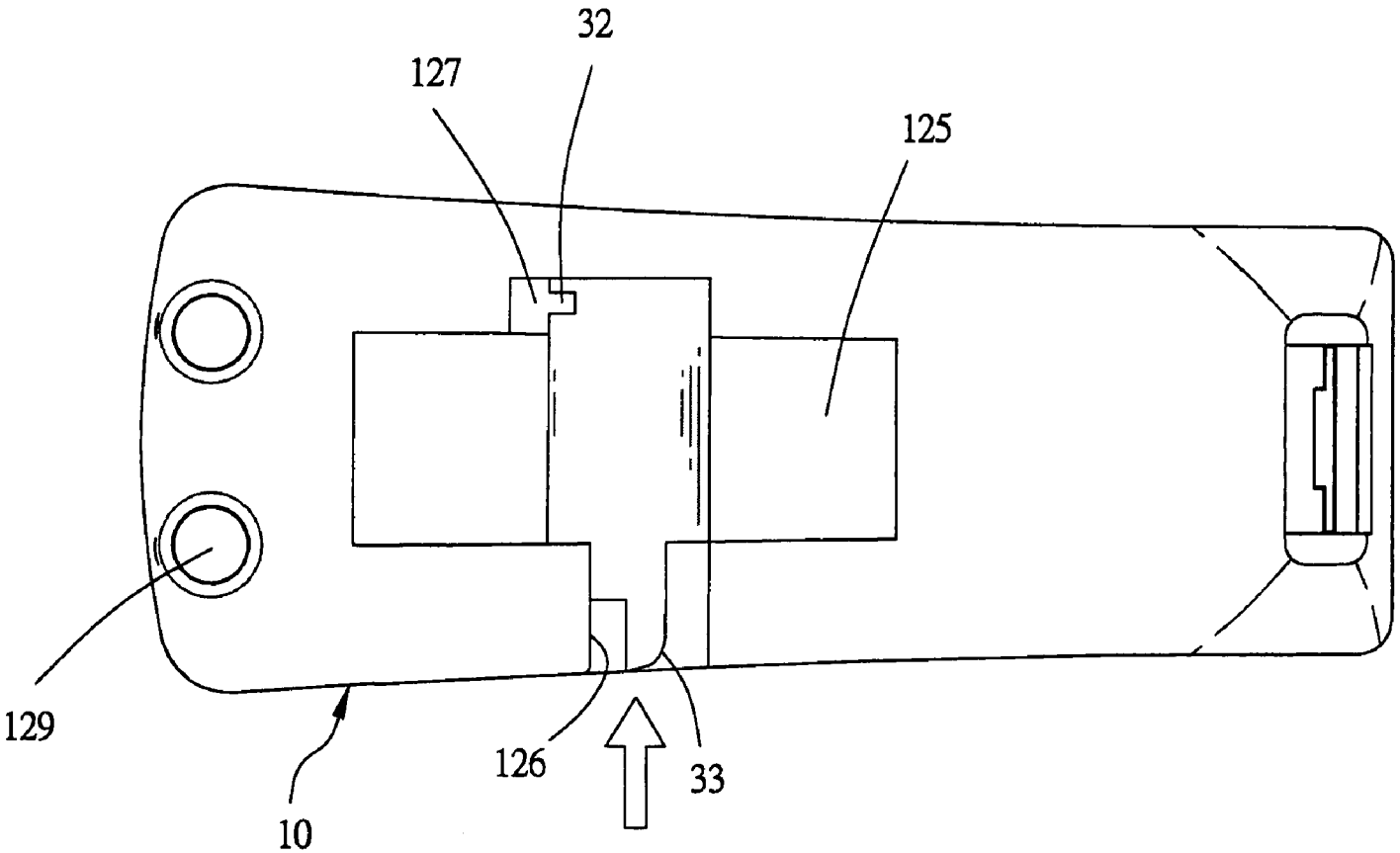
FIG. 5 is an upper view of the shaft in the housing of the tape dispenser in the present invention.
Figure 6:
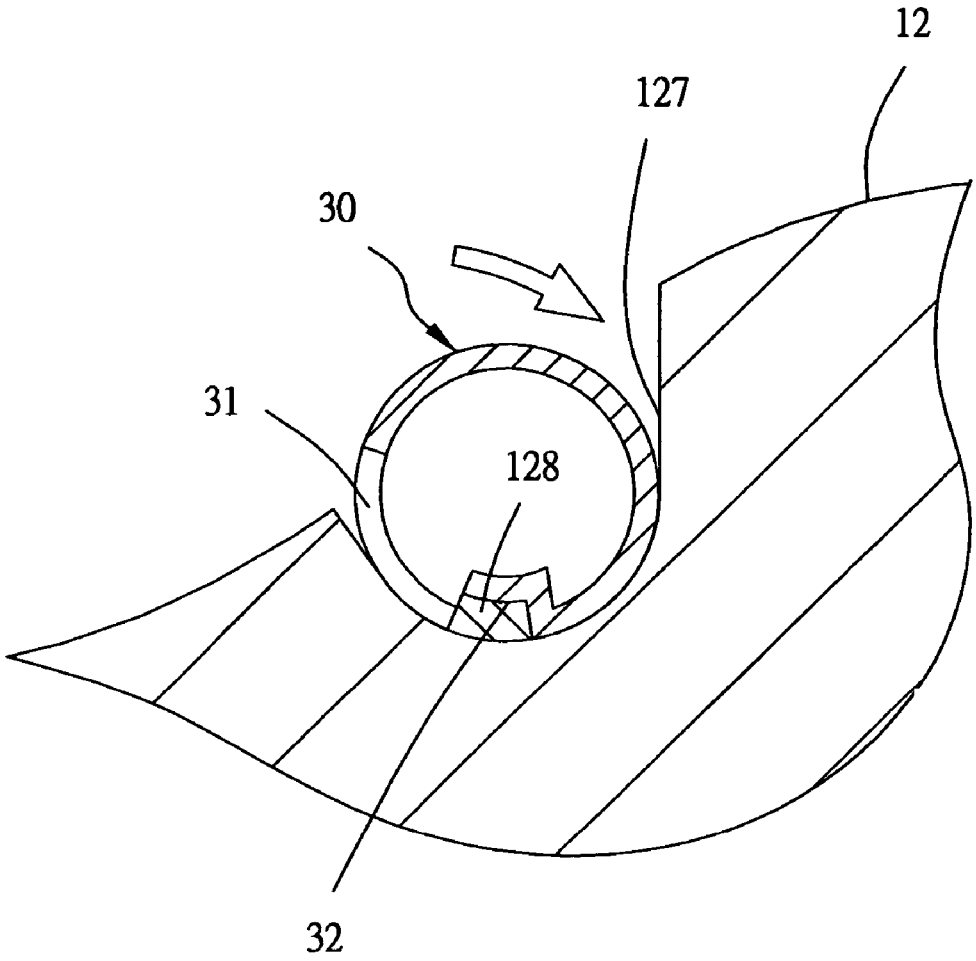
FIG. 6 is a cross-sectional view of the shaft being rotated in the present invention; and, FIG. 7 is a side cross-sectional view of the drawer pulled out of the housing in the present invention.

A preferred embodiment of a tape dispenser with a drawer in the present invention, as shown in FIGS. 1, 2 and 3, includes a housing 10, two drawers 20, a round shaft 30, two anti-slip members 40 and a weight 50 as main components combined together.

The housing 10 is composed of an lower housing 11 and an upper housing 12, and the lower housing 11 has a bottom wall 111, two sidewalls 112 respectively extending upright from two sides of the intermediate portion of the bottom wall 111, two separating walls 113 spaced apart between the two sidewalls 112 for surrounding a hollow chamber 114 and the bottom wall of the hollow chamber 114 bored with two holes 115. Then The two sidewalls 112 located at an outer side of the two separating walls 113 are provided with a first fitting member, which is a protruding edge 116 formed at an upper end of the inner surfaces of the two sidewalls 112. Further, the bottom wall 111 located at the outer side of the separating walls 113 is provided with a first slide guiding member, which is two parallel rails 117 formed on the upper surface of the bottom wall 111, with a stopper 118 formed at the end of each rails 117.

The upper housing 12 has a circumferential sidewall 121 with its lower edge contacting with the upper edge of the two sidewalls 112 of the lower housing 11. The upper housing 12 further has a projecting member 122 on a bottom surface and two posts 123 extending down from the projecting member 122 to face to the two holes 115 of the bottom of the hollow chamber 114 for bolts 124 to screw with for combining the upper and the lower housing 12 and 11 together. Then the front and rear area of the projecting member 122 of the upper housing 12 and the lower housing 11 form to surround a hollow space 13, and the upper housing 12 is provided with a tape recess 125 in an upper surf ace above the projecting member 122 for receiving a tape roll. One sidewall defining the tape recess 125 is provided with a shaft hole 126 of a size larger than a semicircle, and the other sidewall defining the tape recess 125 is provided with a shaft recess 127 of a curved shape with an upper opening and also a fitting projection 128 formed on the wall under the shaft 127. The upper housing further has two pen holes 129 formed in the rear end.

The drawers 20 are composed respectively of a bottom wall 21 and four sidewalls 22, having an interior hollow 23 defined by the bottom 21 and the four sidewalls 22 and opening upward, with two opposite walls 22 provided with a contact edge 24 of a step shape, a recess 25 formed in a rear side to function as a second fitting member, two rail grooves 26 formed in the bottom wall to function as a second slide guiding member. Each rail groove 26 has a stopper 27 at a rear end, so the rails 117 of the lower housing 11 fit with the rail grooves 26 of the drawer 20 when the drawer 20 is received in the space 13, and when the drawer 20 is pushed in, the contact edges 24 of the drawer 20 contacts with and are stopped by the vertical end edge of two sidewalls 112 of the lower housing, with the fitting grooves 25 fitting with the protruding edge 116 of the sidewalls 112 of the lower housing to stabilize the drawer in place. In case of the drawer 20 pulled out, the stoppers 27 of the rail grooves 26 may be blocked by the stoppers 118 of the rails 117, preventing the drawer 20 from completely falling off the housing 10.

The round shaft 30 is almost as long as the distance between the shaft hole 126 and the shaft groove 127, fitting sidewise through the shaft hole 126 first and to fit on the shaft recess 127. The round shaft 30 has a recess 31 formed in the tubular end fitting in the shaft recess 127 for the fitting projection 128 to fit in, and a fitting groove 32 formed in one end of the recess 31, so the fitting projection 128 is stopped by the end of the fitting groove 32, when the round shaft 30 is rotated in a preset direction, so the shaft 30 is limited in its rotation. Further, the shaft 30 has a flat grip 33 formed in the other end fitting in the shaft hole 126, and an upper surface 331 of the grip 33 remains flush with the upper surface of the two lengthwise sides of the housing 10 after the shaft 30 is positioned in place.

The two anti-slip members 40 are attached on the bottom surface of the lower housing 11 for preventing the tape dispenser from moving randomly in case of pulling out the tape for use.

The weight 50 is placed in the hollow chamber 114 of the lower housing 11, augmenting the weight of the tape dispenser to keep it comparatively stably.

Figure 7:
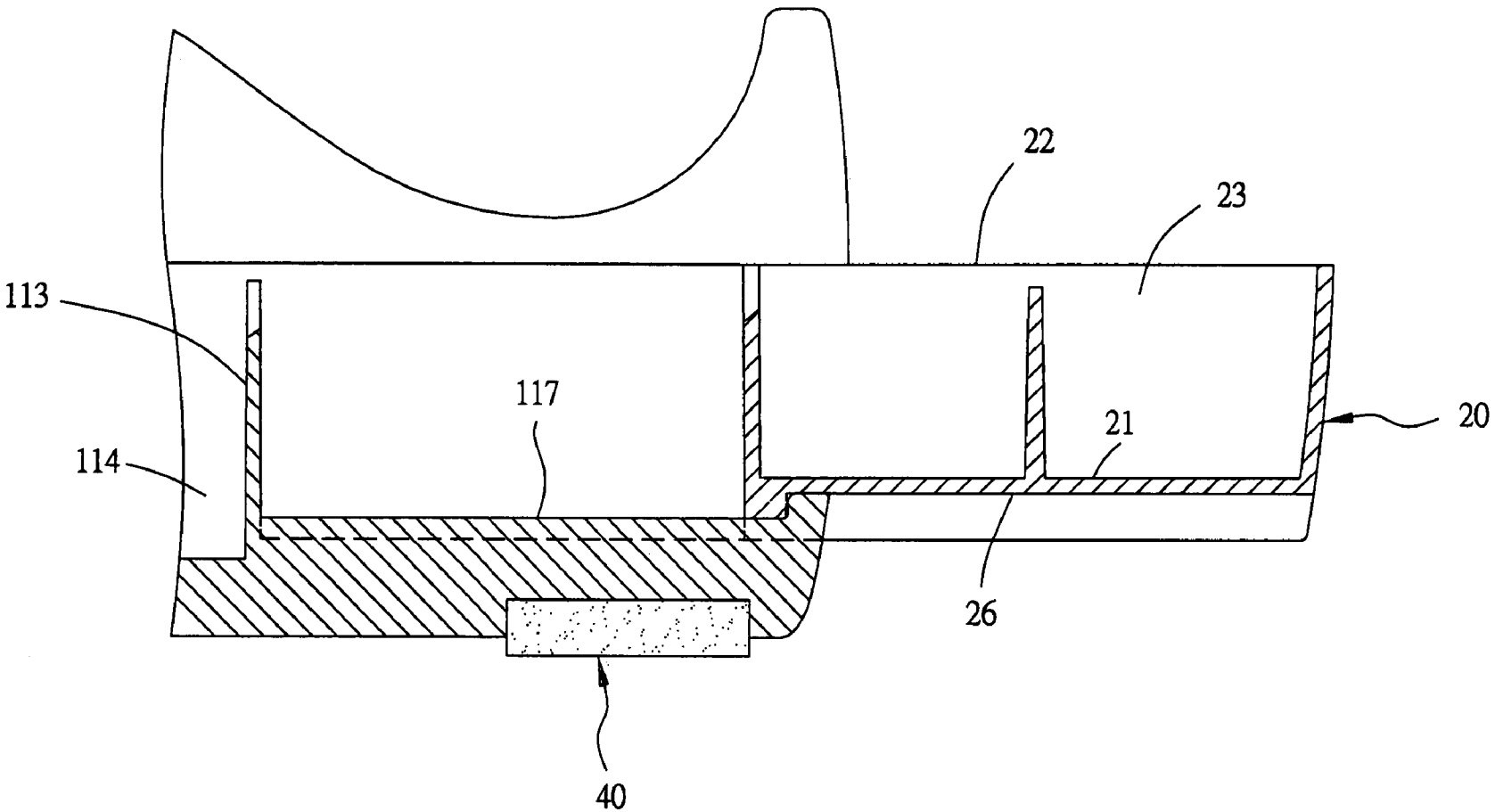

In using, as shown in FIG. 7, a user pushes two sides of the drawer 20 with fingers, and pulls the drawer 20 out with a little force, with the two recesses 25 separating from the protruding edges 116 of the sidewalls 112 of the lower housing 11, and with the rail grooves 26 sliding on the rails 117. During the drawer 20 is pulled out, it will be stopped by the function of the stoppers of the rail grooves 26 of the drawer 20 blocked immovable by the stoppers 118 of the rails 117, without possibility of the drawer 20 falling off the housing 10.

In short, the drawers 20 assembled with the housing 10 fully utilizes the hollow interior of the housing 10, and besides, they are pulled out or pushed in smoothly and kept not to fall off by provisions of the rails fitting with rail grooves and the stoppers.

While the preferred embodiment of the invention has been described above, it will be recognized and understood that various modifications may be made therein and the appended claims are intended to cover all such modifications that may fall within the spirit and scope of the invention.

What is claimed is:

1. A tape dispenser with a drawer, said tape dispenser comprising:

A housing having its upper surface provided with a tape recess for a tape roll being partially received therein, at least a hollow space formed in a lower portion, said hollow space defined by two lengthwise sidewalls, said two sidewalls respectively formed with a first fitting member, said hollow space having a bottom provided with at least a first slide guiding member, and said first slide guiding member having a first stopper at an outer end;

At least a drawer having an upper opening, said drawer constitutes two lengthwise sidewalls and two lateral sidewalls, said two lengthwise sidewalls respectively formed with a second fitting member and at least a second slide guiding member formed in its bottom, said second slide guiding member fitting on said first slide guiding member and shifting thereon in case of said drawer is pushed in said hollow space, said drawer having a second stopper formed at a rear end to be stopped by said first stopper in case of said drawer is pulled out, said drawer is limited in its position when pulled out for preventing from falling off; and said housing is provided with a tape recess in an upper surface for receiving partially a tape roll, one sidewall defining said tape recess is formed with a shaft hole of a shape larger than a semicircle, another sidewall defining said tape recess is formed with a shaft recess and a fitting projection formed on a bottom surface under said shaft recess, a round shaft has two ends respectively placed in said shaft hole and said shaft recess, and penetrates center hole of a tape roll, said shaft having a tubular end fitting in said shaft recess and a notch formed in said tubular end for said fitting projection to fit therein, said notch having its end formed with a fitting groove, said fitting projection fitting in said fitting groove to stop said round shaft to limit its position in case said round shaft is rotated in a preset direction.

2. The tape dispenser with a drawer as claimed in claim 1, wherein said first fitting member and said second fitting member are respectively protruding edges and recesses.

3. The tape dispenser with a drawer as claimed in claim 1, wherein said first slide guiding member and said second slide guiding member are respectively rails and rail grooves.

4. The tape dispenser with a drawer as claimed in claim 1, wherein two first slide guiding members and two second slide guiding members are used therein.

5. The tape dispenser with a drawer as claimed in claim 1, wherein said housing is composed of an upper housing and a lower housing combined together, forming said hollow space between both said housings.

6. The tape dispenser with a drawer as claimed in claim 1, wherein said lower housing is provided with a hollow chamber for placing a weight therein.

7. The tape dispenser with a drawer as claimed in claim 1, wherein said housing is provided with a pen hole formed in a rear end for a pen to be inserted therein.

8. The tape dispenser with a drawer as claimed in claim 1, wherein said round shaft has a length almost the same as the distance between said shaft hole and said shaft recess, one end of said shaft fitting in said shaft hole is formed with a flat grip, and said grip has its upper surface flush with an upper surface of an upper surface of two lengthwise sides of said housing.

9. The tape dispenser with a drawer as claimed in claim 1 wherein said housing has at least an anti-slip member attached on the bottom surface.

* * * * *